US008210655B2

(12) United States Patent
Muraoka et al.

(10) Patent No.: US 8,210,655 B2
(45) Date of Patent: Jul. 3, 2012

(54) LIQUID EJECTION HEAD AND MANUFACTURING METHOD OF LIQUID EJECTION HEAD

(75) Inventors: Chiaki Muraoka, Kawaguchi (JP); Yukuo Yamaguchi, Tokyo (JP); Mikiya Umeyama, Tokyo (JP); Toru Yamane, Yokohama (JP); Masaki Oikawa, Inagi (JP); Yuichiro Akama, Kawasaki (JP); Keiji Tomizawa, Yokohama (JP); Tomotsugu Kuroda, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 546 days.

(21) Appl. No.: 12/364,217

(22) Filed: Feb. 2, 2009

(65) Prior Publication Data

US 2009/0201343 A1 Aug. 13, 2009

(30) Foreign Application Priority Data

Feb. 7, 2008 (JP) ..... 2008-027696

(51) Int. Cl.
*B41J 2/05* (2006.01)
*B41J 2/14* (2006.01)

(52) U.S. Cl. ..... 347/65; 347/47

(58) Field of Classification Search ..... 347/47, 347/65

See application file for complete search history.

(56) References Cited

U.S. PATENT DOCUMENTS

| | | | | |
|---|---|---|---|---|
| 7,048,358 | B2 * | 5/2006 | Kubota et al. | 347/56 |
| 7,387,371 | B2 | 6/2008 | Oikawa | |
| 2007/0030305 | A1 * | 2/2007 | Maher et al. | 347/40 |
| 2007/0206065 | A1 | 9/2007 | Tomizawa et al. | |
| 2008/0111868 | A1 | 5/2008 | Yamane | |
| 2008/0252698 | A1 | 10/2008 | Kudo et al. | |
| 2009/0058933 | A1 | 3/2009 | Matsumoto et al. | |

FOREIGN PATENT DOCUMENTS

| | | |
|---|---|---|
| JP | 2006-290000 | 10/2006 |

* cited by examiner

*Primary Examiner* — Geoffrey Mruk
(74) *Attorney, Agent, or Firm* — Fitzpatrick, Cella, Harper & Scinto

(57) ABSTRACT

The present invention provides a liquid ejection head for which the peeling of an orifice plate from a substrate seldom occurs, even in a structure such that the walls that define each energy application chamber are narrowed toward an ejection port. The walls that define a first pressure chamber are inclined inward within the first pressure chamber, so that the first pressure chamber is narrowed, toward an ejection port, along a direction perpendicular to the heater formation face on which heaters are arranged. Further, the walls that define each ink flow path are inclined in the ink ejection direction. Furthermore, the angle at which the walls that define the ink flow path are inclined relative to the ink ejection direction is smaller than the angle at which the walls that define the first pressure chamber are inclined inward, within the first pressure chamber.

8 Claims, 17 Drawing Sheets

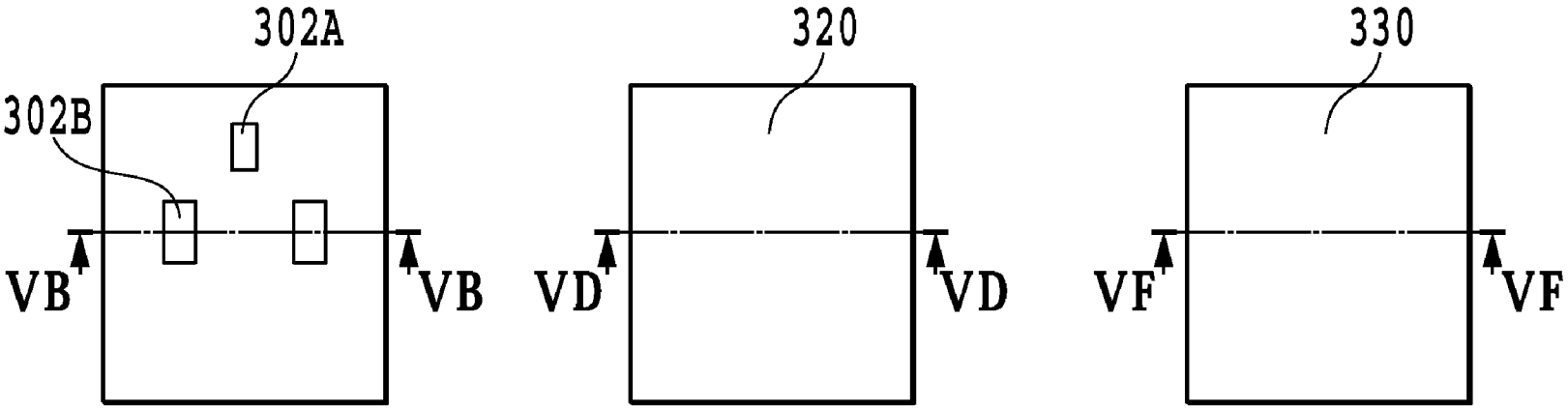
FIG.5A
FIG.5C
FIG.5E
FIG.5B
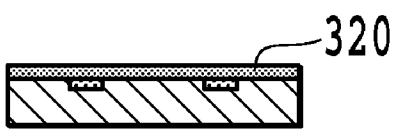
FIG.5D
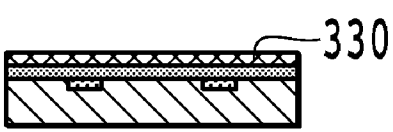
FIG.5F

LIQUID EJECTION HEAD AND MANUFACTURING METHOD OF LIQUID EJECTION HEAD

BACKGROUND OF THE INVENTION

1. Field of the Invention

The present invention relates to a liquid ejection head for ejecting a liquid onto a printing medium and a manufacturing method for the liquid ejection head.

2. Description of the Related Art

One type of common printing apparatus is an inkjet printing apparatus that applies energy to ink contained in the energy application chambers of a print head, and ejects ink droplets through ejection ports.

A partial structure of an example print head employed for such an inkjet printing apparatus is disclosed in FIG. 9.

Another example print head for an inkjet printing apparatus is disclosed, for example, in Japanese Patent Laid-Open No. 2006-290000. The print head proposed in Japanese Patent Laid-Open No. 2006-290000 has nozzles in which the walls defining the energy application chambers are tapered so that the energy application chambers are narrowed as ejection ports are neared. Thus, since the energy application chambers narrow as they near the ejection ports, the resistance of ink is reduced as the ink transfers through the energy application chambers. Therefore, little energy is required to eject ink, and during printing, the ink ejection efficiency is improved.

Recently, print heads, for use in inkjet printing apparatuses, that can perform high-speed, high-quality printing, is strongly desired. In order to satisfy these requests, it is needed that the nozzles are arranged at much high densities. With a structure wherein nozzles are arranged at a high density, high resolution images can be printed that provide improved image quality. In addition, because of the structure of the print head of the inkjet printing apparatus, the increase in the nozzle density is available at a comparatively low cost.

In the print head disclosed in Japanese Patent Laid-Open No. 2006-290000, however, when the energy application chambers are narrowed as they approach ejection ports, the bottom faces of the energy application chambers, wherein printing elements are located, are comparatively wide. And generally, an orifice plate, in which ejection ports are formed, and a substrate, on which the printing elements are arranged, are adhered to each other, on the printing element formation faces of the energy application chambers, wherein the printing elements are located. Therefore, when the nozzles are arranged at a high density and the energy application chambers are tapered, the size of the area to which the substrate and the orifice plate, in which the ejection ports are formed, are adhered tends to be reduced, relative to the flow rate of a liquid that is supplied to the energy application chambers. Thus, essentially, the size of the area available for the adhesion of the orifice plate and the substrate is insufficient, and the possibility exists that these components will be separated from each other.

SUMMARY OF THE INVENTION

Thus, in view of the above-described circumstances, an object of the present invention is to provide a liquid ejection head such that, although the walls that define energy application chambers become narrower as the walls near the ejection ports, the orifice plate can not be peeled off the substrate easily. A further objective of the present invention is to provide a manufacturing method for the liquid ejection head.

The first aspect of the present invention is a liquid ejection head comprising: nozzles, each including an energy application chamber for internally containing a liquid, a printing element, located in the energy application chamber for generating energy that is to be applied to the liquid contained in the energy application chamber, an ejection port, communicating with the energy application chamber, for ejecting the liquid to which the energy is applied by the printing element, and a liquid flow path used to supply the liquid from a liquid supply port to the energy application chamber, wherein walls that define the energy application chamber are inclined inward, within the energy application chamber, relative to a direction perpendicular to a printing element formation face on which the printing element is arranged, so that near the ejection port the energy application chamber is narrowed, wherein walls that define the liquid flow path are inclined relative to a liquid ejection direction, and wherein an angle at which the walls that define the liquid flow path are inclined relative to the liquid ejection direction is smaller than an angle at which the walls that define the energy application chamber are inclined inward, within the energy application chamber.

The second aspect of the present invention is a manufacturing method, for a liquid ejection head that includes nozzles, each of which includes an energy application chamber located between a substrate and an orifice plate to internally contain a liquid, a printing element, located in the energy application chamber for generating energy that is to be applied to the liquid contained in the energy application chamber, an ejection port, communicating with the energy application chamber, for ejecting the liquid to which the energy is applied by the printing element, and a liquid flow path used to supply the liquid from a liquid supply port to the energy application chamber, comprising the steps of: sequentially forming n photosensitive resin layers (n: an integer) on the substrate on which the printing elements are arranged; irradiating an n-th, topmost formed layer with light that is corresponding to a photosensitive characteristic of the n-th layer, and exposing the n-th layer, via an n-th mask, while remaining a predetermined pattern for the n-th layer, and removing part of the n-th layer; repeating the same process as that used to form the predetermined pattern for the n-th resin layer, by irradiating a first resin layer, located at the n-th position from the top, with light that is corresponding to a photosensitive characteristic of the first resin layer, exposing the first resin layer, via a first mask, to remain a predetermined pattern for the first resin layer, and removing part of the first resin layer; applying an orifice plate formation material, used to form the orifice plate, so as to cover the substrate on which the residual portions of the first resin layer to the n-th resin layer are arranged; forming ejection ports at predetermined positions; and partially removing the first resin layer to the n-th resin layer remained on the substrate, so that, at the least, the energy application chambers or the liquid flow paths, formed in a liquid ejection direction of multiple differently shaped layers, are obtained.

The third aspect of the present invention is a manufacturing method, for a liquid ejection head that includes nozzles, each of which includes an energy application chamber located between a substrate and an orifice plate to internally contain a liquid, a printing element, located in the energy application chamber for generating energy that is to be applied to the liquid contained in the energy application chamber, an ejection port, communicating with the energy application chamber, for ejecting the liquid to which the energy is applied by the printing element, and a liquid flow path used to supply the liquid from a liquid supply port to the energy application chamber, comprising the steps of: sequentially forming a first resin layer and a second resin layer on the substrate on which the printing elements are arranged; irradiating the second resin layer with light that is corresponding to a photosensitive characteristic of the second resin layer, and exposing the second resin layer, via a second mask, while remaining a predetermined pattern for the second resin layer, and removing part of the second resin layer; irradiating a first resin layer with light that is corresponding to a photosensitive characteristic of the first resin layer, exposing the first resin layer, via a first mask, to remain a predetermined pattern for the first resin layer, and removing part of the first resin layer; applying an orifice plate formation material, used to form the orifice plate, so as to cover the substrate on which the residual portions of the first resin layer and the second resin layer are arranged; forming ejection ports at predetermined positions; and partially removing the first resin layer and the second resin layer remained on the substrate, so that, at the least, the energy application chambers or the liquid flow paths, formed in a liquid ejection direction of two differently shaped layers, are obtained.

According to this invention, although the widths of the energy application chambers are reduced as they near the ejection ports, a sufficiently large area is obtained for the printing element formation area of the liquid ejection head. Thus, a reliable liquid ejection head can be provided, as can a method for manufacturing the liquid ejection head.

Further features of the present invention will become apparent from the following description of exemplary embodiments (with reference to the attached drawings).

DESCRIPTION OF THE EMBODIMENTS

The preferred embodiments of the present invention will now be described while referring to accompanying drawings.

First Embodiment

Figure 1:
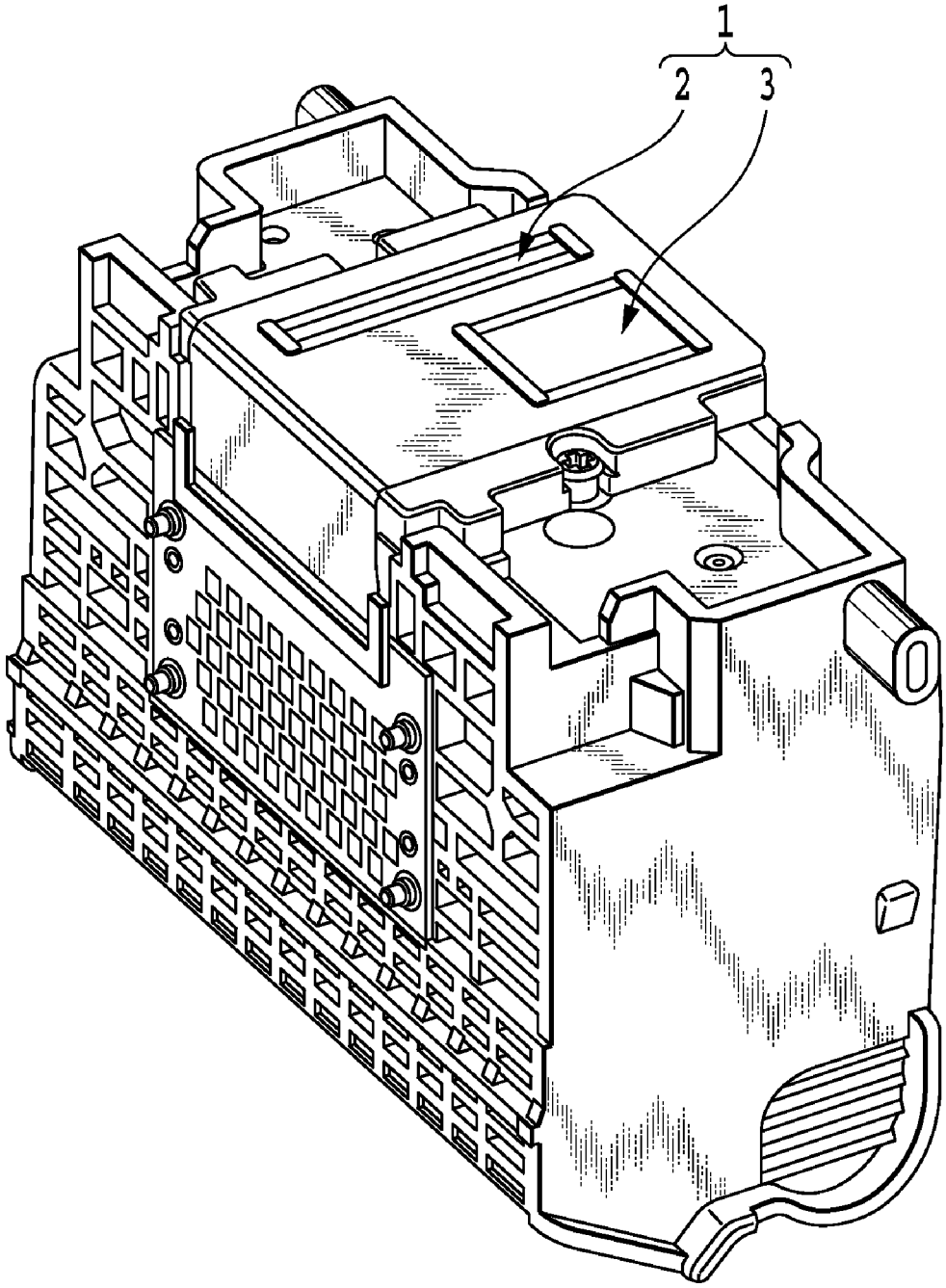
FIG. 1 is a perspective view of an inkjet cartridge that employs a print head according to a first embodiment of the present invention.

FIG. 1 is a perspective view of an inkjet cartridge, which is employed for a printing apparatus, such as an inkjet printing apparatus, and on which a print head 1 is mounted as a liquid ejection head according to a first embodiment of the present invention. The print head 1 of this embodiment includes a pigment ink chip 2, used for the ejection of black pigment ink, and a dye ink chip 3, used for the ejection of dye color ink. The print head 1, equipped with these chips 2 and 3, is mounted on an inkjet cartridge that is to be loaded into a printing apparatus (not shown). The respective chips, pigment ink chip 2 and dye ink chip 3, each have a plurality of ejection ports through which ink droplets can be ejected, respectively. During the printing process, ink droplets are ejected onto a print medium that is positioned opposite the print head 1, and a predetermined image is formed on the print medium by the ink droplets that land thereon.

The main purpose for which the black pigment ink is used is the printing of text, and therefore, a high resolution, in demand for the printing of images, is not required for the pigment ink chip 2. Therefore, the amount of ink droplets ejected by the pigment ink chip 2 are relatively large, each amounting to about 30 pl of ink, while the amount of ink droplets ejected by the dye ink chip 3 are smaller, each amounting to about 1-5 pl of ink. Consequently, the ejection ports provided for the pigment ink chip 2 are usually larger than those provided for the dye ink chip 3. In this embodiment, for the pigment ink chip 2, two ejection port arrays of 256 ejection ports are arranged, at a pitch of 300 dpi (about 84 μm), one on each of two sides of a liquid supply port, such as an ink supply port, i.e., a total of 512 ejection ports are prepared for the two sides.

Figure 2:
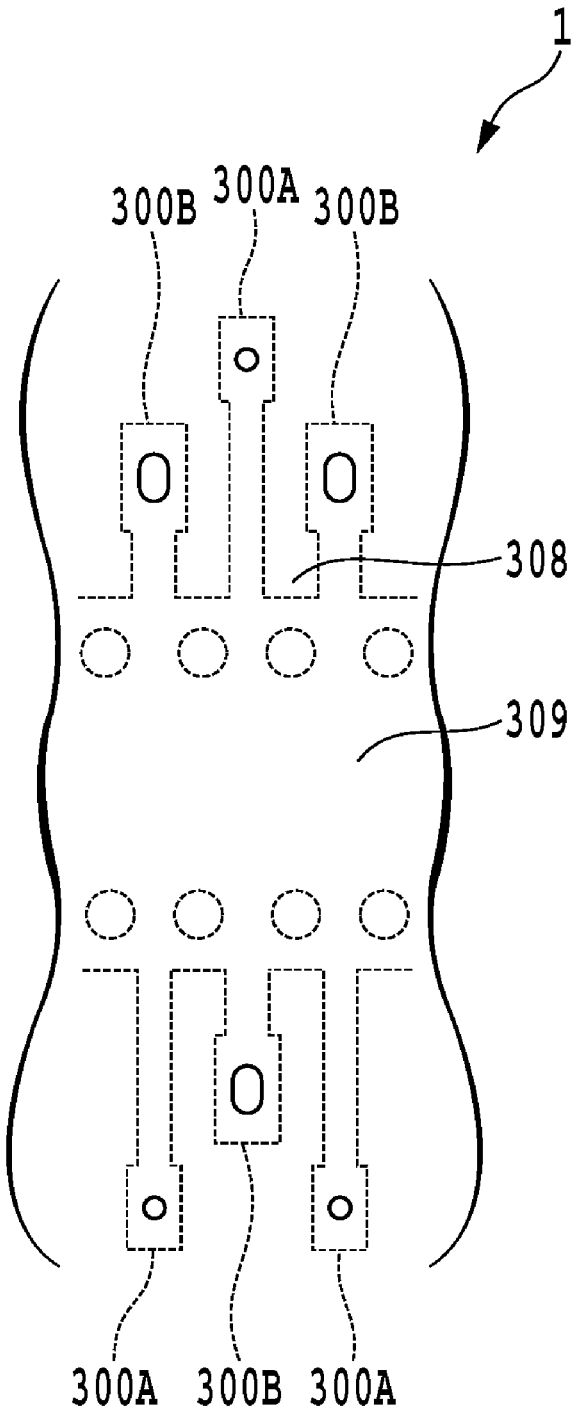
FIG. 2 is an enlarged diagram illustrating the essential portion of the print head of the inkjet cartridge in FIG. 1.

FIG. 2 is a diagram illustrating the nozzle arrangement of the dye ink chip 3 for which the invention is applied. A nozzle 300 includes a pressure chamber 500, an ejection port 301 and an ink flow path 306 (see FIGS. 3A to 3C). A nozzle array is arranged on either side, along a common liquid chamber 309 and an ink supply port, which is formed in the common liquid chamber 309, in the direction in which the ink supply port is extended. Further, each of the two nozzle arrays is formed by alternately arranging, at a pitch of 1200 dpi, two types of nozzles, 300A and 300B, which differ in the volume of ink they eject and in their ink flow paths, which will be described later. An orifice plate 308 is located between adjacent nozzles to partition them. In this arrangement, the nozzles 300B are located opposite the nozzles 300A, across the common liquid chamber 309. According to this embodiment, nozzle arrays are formed on two sides of the ink supply port; however, instead of this arrangement, a nozzle array may be formed in a zigzag manner on at least one side of the ink supply port.

Figure 3A:
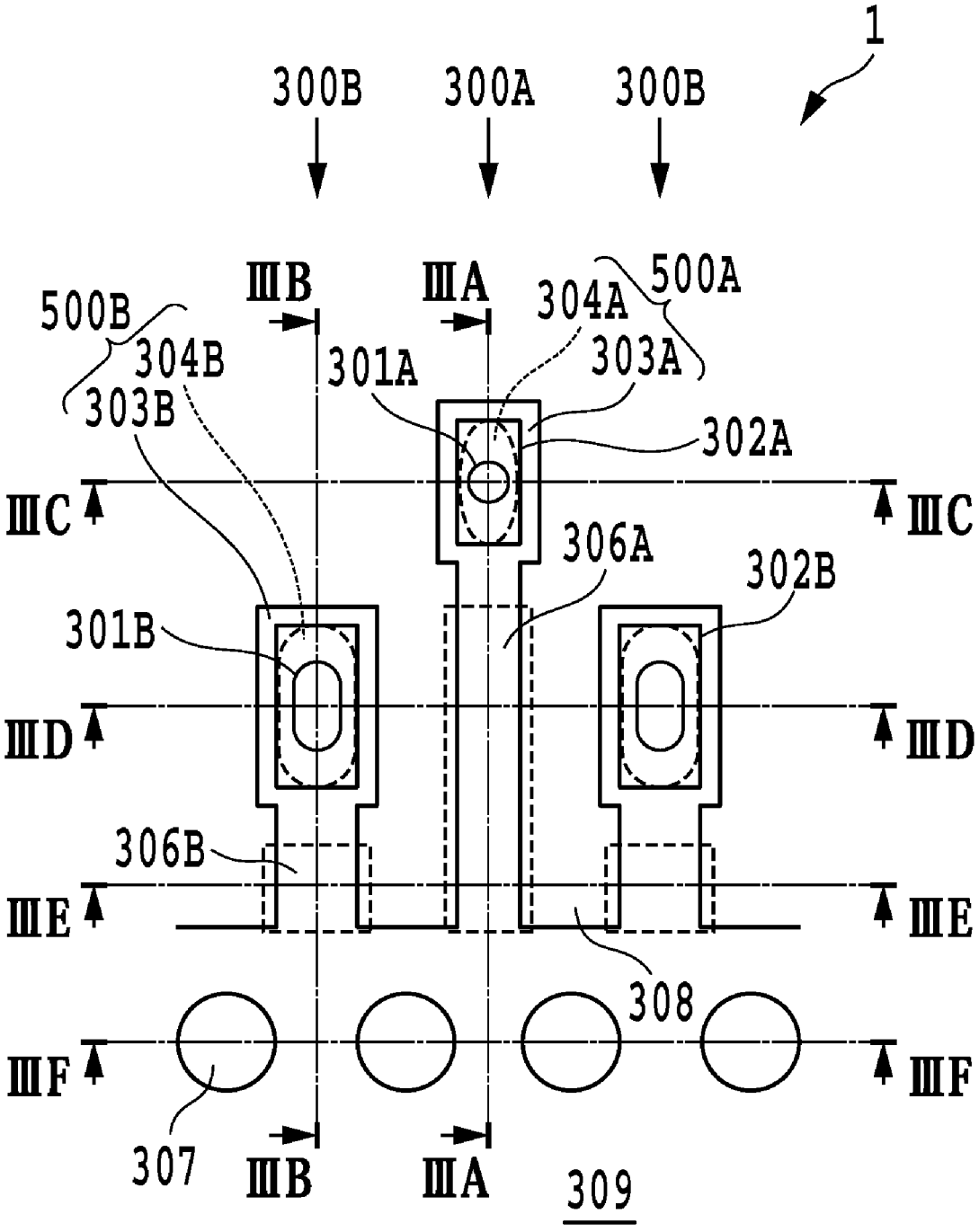
FIG. 3A is a plan view for explaining the nozzle arrangement provided for the print head in FIG. 2.
Figure 3B:
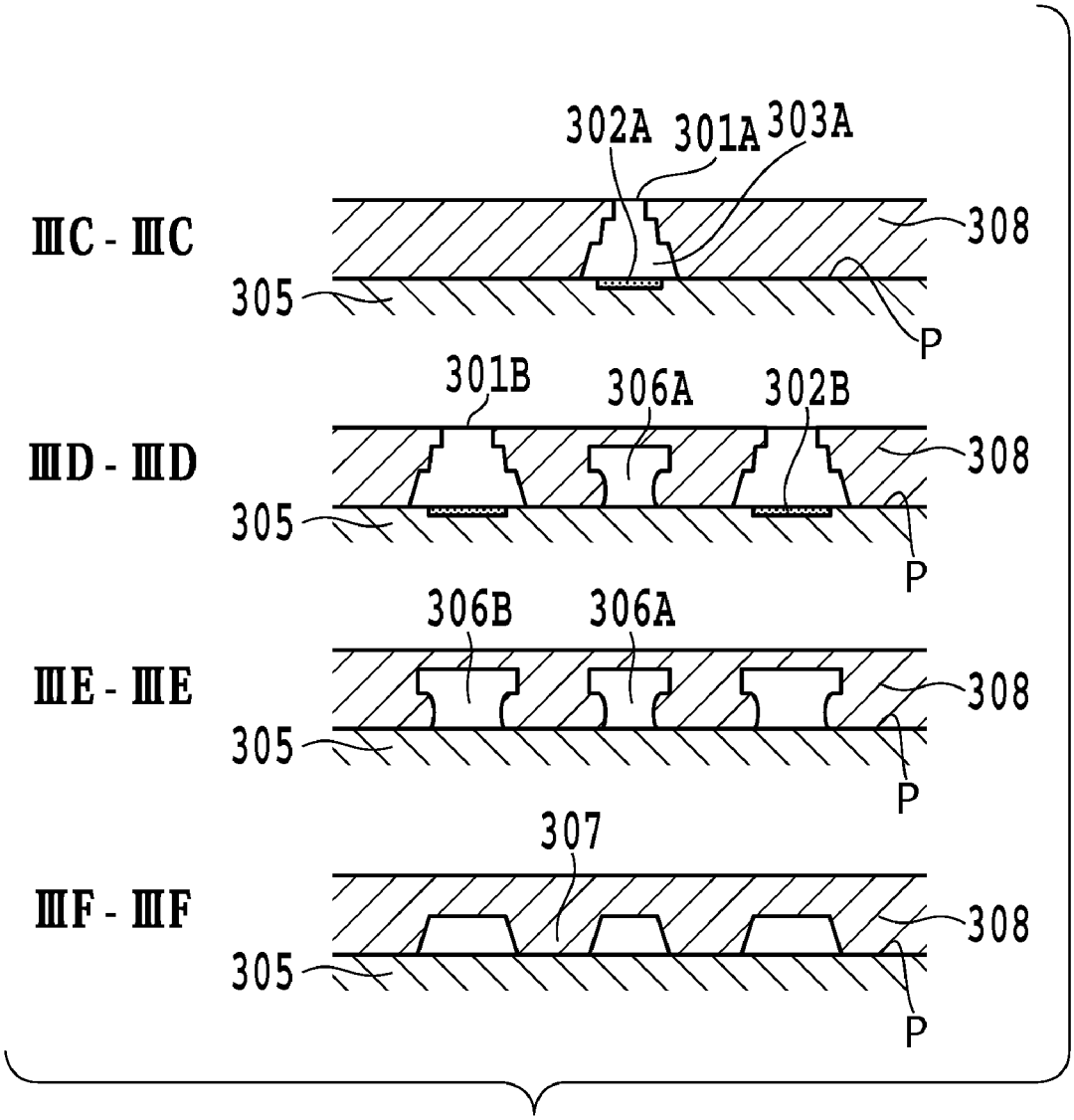
FIG. 3B is a cross-sectional view taken along lines IIIC-IIIC, IIID-IIID, IIIE-IIIE and IIIF-IIIF in FIG. 3A.
Figure 3C:
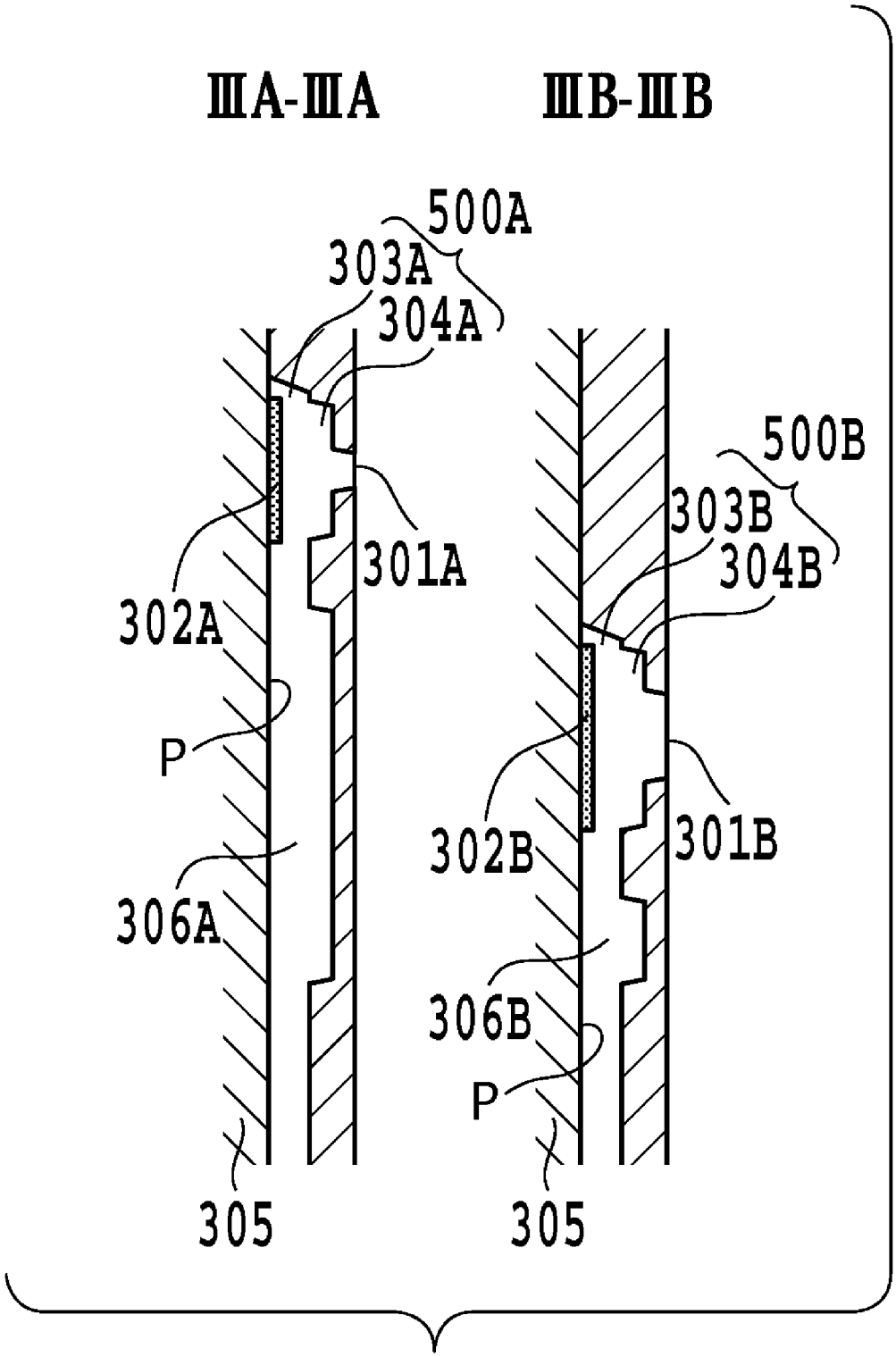
FIG. 3C is a cross-sectional view taken along lines IIIA-IIIA and IIIB-IIIB in FIG. 3A.

FIGS. 3A to 3C are diagrams illustrating the nozzle arrangement for which the present invention is applied, while FIG. 3A is a plan view of the print head 1 according to this embodiment. FIG. 3B is a cross-sectional view, taken along lines IIIC-IIIC, IIID-IIID, IIIE-IIIE and IIIF-IIIF in FIG. 3A, and FIG. 3C is a cross-sectional view, taken along lines IIIA-IIIA and IIIB-IIIB.

As shown in FIG. 3B, for the print head 1 of this embodiment, a substrate 305 is adhered to the orifice plate 308, and thus, the pressure chambers 500 are formed as energy application chambers in which ink, as an example liquid, is to be contained. Inside the pressure chambers 500, heaters 302 are arranged as printing elements that generates energy to be applied to ink that is contained in the pressure chambers 500. Further, the ejection ports 301 are arranged at positions opposite the heaters 302 and communicate with the pressure chamber 500, so that, by the application of the energy generated by the heaters 302 to ink, the ink is ejected from the ejection ports 301.

Furthermore, as illustrated in FIG. 3A, nozzle arrays are located on either side along the common liquid chamber 309 and the ink supply port. Each of the nozzle arrays is formed by alternately arranging two types of nozzles: nozzles having a comparatively long ink flow path 306A and nozzles having a comparatively short ink flow path 306B. The ink flow paths 306 are flow paths along which ink, supplied from an ink tank (not shown) to the ink supply port, is moved from the common liquid chamber to fill the ink pressure chambers 500, wherein the ink is contained. In this embodiment, the nozzles having the comparatively long ink flow paths 306A are defined as nozzles 300A, while the nozzles having the comparatively short flow paths 306B are defined as nozzles 300B. Furthermore, the ejection ports for the nozzles 300A are defined as ejection ports 301A, and the heaters therefor are defined as heaters 302A. Likewise, the ejection ports for the nozzles 300B are defined as ejection ports 301B, and the heaters therefor are defined as heaters 302B.

In this embodiment, the area of openings provided for the ejection ports 301A are smaller than those for the ejection ports 301B, and thus, the amount of the ink droplets ejected through the ejection ports 301A are smaller than those ejected through the ejection ports 301B. Furthermore, the areas of the heaters 302A are, consequently, smaller than are those of the heaters 302B, and generate less heat.

The portions of the pressure chambers 500B, for the nozzles 300B having the shorter ink flow paths 306B, that are farthest from the ink supply port are nearer the ink supply port than the portions of the pressure chambers 500A, for the nozzles 300A having the longer ink flow path 306A, that are nearest from the ink supply port. Therefore, the nozzles 300A and the nozzles 300B are arranged in a zigzag pattern so that the pressure chambers 500A and 500B do not overlap in the direction in which the nozzle are arranged.

In addition, the walls that define the pressure chambers 500 are inclined within the pressure chambers 500, so that, in a direction perpendicular to a heater formation face P, which is a printing element formation face on which heaters are arranged, the pressure chambers 500 narrow as they approach the ejection ports 301.

In this embodiment, each of the pressure chambers 500 includes: a first pressure chamber 303, which serves as a first energy application chamber that communicates with an ink flow path; and a second pressure chamber 304, which serves as a second energy application chamber that communicates with an ejection port. The inward inclination, within the pressure chambers 500, of the walls that define the first pressure chambers 303 is greater than the inward inclination of the walls of the second pressure chambers 304. Further, the volume of the first pressure chamber 303 is greater than the volume of the second pressure chamber 304. As shown by cross-sectional views in FIGS. 3B and 3C, for both the nozzles 300A and 300B, the first pressure chambers 303A and 303B have larger volumes than have the second pressure chambers 304A and 304B. The sizes of the second pressure chambers 304A and 304B are such that, were the first and second pressure chambers 303 and 304 to be projected to the heater formation face, the second pressure chambers 304A and 304B would respectively be enclosed in the first pressure chambers 303A and 303B.

In this embodiment, all the walls that form the first pressure chambers 303A and 303B are inclined to narrow their openings toward the ejection port 301. Furthermore, the walls of the second pressure chambers 304A and 304B and the ejection ports 301 are inclined so their openings also narrow in the ejection direction. It should be noted, however, that the walls of the second pressure chambers 304 have an inclination that is slightly less than that of the walls of the first pressure chambers 303. And since the walls of the first pressure chambers 303 have the greater inclination, the flow of ink can be adjusted in the ejection direction at a location near the bubble generation position. This provides improved ink ejection efficiency.

The operation of the print head 1 mounted in the printing apparatus to perform printing will now be described.

When the heaters 302A and 302B are activated, they rapidly heat ink contacting their surfaces, causing film boiling of ink and generating bubbles. Thus, at the heater surfaces, bubble pressure is built up and, in general, is controlled by the shapes and the inclinations of the walls of the first pressure chambers 303A and 303B which enclose the heaters 302A and 302B and the second pressure chambers 304A and 304B, and ink is guided toward the ejection ports 301. Ink to be ejected is supplied from the common liquid chamber 309, through a filter 307 and along the ink flow paths 306A and 306B, to the individual pressure chambers 500. For this supply procedure, the filters 307, for filtering the ink that is supplied, are so arranged that foreign substances such as dust, which can obstruct the ejection of ink, are prevented from entering the nozzles.

Figure 4A:
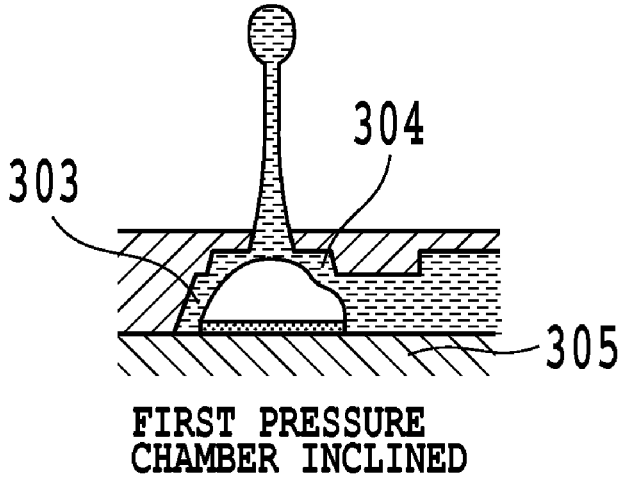
FIG. 4A is a cross-sectional view of the state wherein ink droplets are to be ejected by the print head in FIGS. 3A to 3C, wherein the walls that define a first pressure chamber are inclined.
Figure 4B:
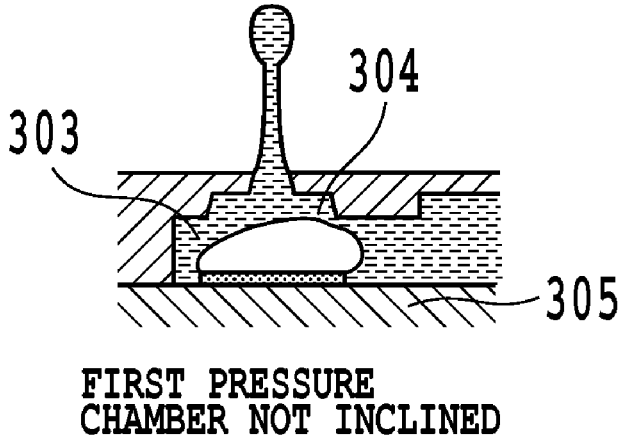
FIG. 4B is a cross-sectional view of the state wherein ink droplets are to be ejected by a print head, as a comparison example, wherein the walls that define a first pressure chamber are not inclined.

The effects obtained when the walls of the first pressure chamber are formed and inclined as described above will now be described. FIGS. 4A and 4B are cross-sectional views, taken in the ink supply direction, of the states existing immediately after the start of ejection of ink, through the nozzles of the print head 1, was started.

Except for the first pressure chamber portions 303, the nozzles illustrated in FIGS. 4A and 4B are shaped the same. Further, for the print head in FIG. 4A the walls of the first pressure chamber 303 are inclined, as in this embodiment, whereas for the print head in FIG. 4B the walls of the first pressure chamber 303 are not inclined. In FIG. 4A, a bubble generated by that heater 302 grows more evenly along the wall faces in the ink ejection direction. And as a result, ink flows more rapidly toward the ejection port 301 and a higher ink ejection velocity is attained than that provided by the print head in FIG. 4B. In other words, the ejection efficiency provided by the print head in FIG. 4A is better, i.e., to provide the same ejection velocity as does the print head in FIG. 4B, the generation of a smaller amount of heat is required of the heater 302 for the print head shown in FIG. 4A. Thus, since the amount of heat required can be reduced, a temperature rise at the substrate 305, during the driving of the heater 302, can be decreased. Therefore, when an ink droplet has been ejected and ink is supplied thereafter to refill the pressure chamber 500, no unnecessary heating of the ink in the pressure chamber 500 will occur, and the ink ejection state will be prevented from becoming unstable.

However, when the walls of the pressure chamber 500 are formed and inclined in this manner, the area of an opening at the pressure chamber 500 are greater at a location nearer the heater 302 in the ink ejection direction. With this arrangement, therefore, the area where the orifice plate 308 is adhered to the substrate 305 tends to be narrowed, relative to the amount of the ink supplied through the ink supply port to the pressure chambers 500. As a result, the orifice plate 308 could easily be peeled off the substrate 305, and accordingly, a less reliable print head provided. Furthermore, near the heaters, the walls between adjacent nozzles may be too thin, and consequently, the print head would have insufficient strength.

However, according to the print head 1 of this embodiment, the walls used to define liquid flow paths, the ink flow paths 306, are inclined relative to the direction in which a liquid is ejected. And furthermore, the angle at which the walls that define the ink flow paths 306 are inclined is smaller than the angle at which the walls that define the pressure chambers 500 are inclined inward in the pressure chamber 500. That is, when a face perpendicular to the heater formation face P is employed as a reference, the walls that form the ink flow paths 306A and 306B on the heater formation face P are inclined toward the outside, rather than toward the walls that define the pressure chambers 500. Also, the walls that define the ink flow paths 306 may be inclined in a negative direction by employing a reference face that is perpendicular to the heater formation face P, i.e., may be inclined outward, along the ink flow paths 306, from the face perpendicular to the heater formation face P. Therefore, even when the walls that partition the nozzles may be thin at locations between the nozzles near the pressure chambers 500, the inclination angle of the walls that define the ink flow paths 306 is smaller near the ink flow paths 306 than the angle employed for the pressure chambers 500, and only rarely the thicknesses of the walls between the nozzles will be reduced. Therefore, the strength of the print head 1 is maintained.

Further, especially in this embodiment, the width of the outermost portion of the ink flow path 306 in the ink ejection direction as the liquid ejection direction, is greater than the width of the innermost portion.

In addition, the ink flow paths 306 are formed so that two flow paths, having almost rectangular shapes in cross section, are arranged in parallel in the ink ejection direction. And the width of the outside portions of the flow paths in the ink ejection direction is greater than the width of the inside portions of the flow paths in the ink ejection direction.

In this embodiment, the outside portion in the ink ejection direction represents the portion near the ejection port 301 through which ink droplets are to be ejected. The inside portion in the ink ejection direction represents the portion near the substrate 305 of the print head 1.

As illustrated in cross-sectional views taken along lines IIID-IIID and IIIE-IIIE of FIG. 3B, for the ink flow paths 306A and 306B, two flow paths having almost rectangular shapes are formed in parallel in the ink ejection direction. The upper portions of the flow paths, which are nearer the outside in the ejection direction of the print head 1, are wider than the lower portions that are nearer the substrate 305 in the ejection direction. Further, the upper layers and lower layers of the walls that form the ink flow paths 306A and 306B are only slightly inclined relative to the ink ejection direction, i.e., are almost perpendicular to the heater formation face P. The cross-sectional sizes of the ink flow paths 306A and 306B are adjusted in accordance with the amount of the ink ejected from the nozzles and the maximum ejection frequency, so that a necessary and adequate ink supply velocity can be obtained. That is, it is preferable that the cross-sectional sizes of the ink flow paths 306A and 306B be as large as possible, so as to increase the supply speed and to eject a larger amount of ink during a shorter discharge cycle.

Further, in this embodiment, the outside portions of the flow paths in the ink ejection direction are wider than the inside portions in the ink ejection direction. Therefore, the walls that define the ink flow paths 306 are inclined and extended outward, from the face perpendicular to the heater formation face P, in a direction in which ink is to be ejected.

Referring to the cross sections taken along line IIID-IIID for the ink flow path 306A and the first pressure chamber 303B, and the cross sections taken along line IIIE-IIIE for the ink flow paths 306A and 306B, the contact area for the adherence of the substrate 305 and the orifice plate 308 is determined in accordance with the width of the lowermost opening. In order to obtain an appropriate cross-sectional size for the ink flow paths and a large contact area for the substrate 305 and the orifice plate 308, it is preferable that the walls of the ink flow paths 306A and 306B be inclined, not in a like manner as the walls of the first pressure chambers 303A and 303B, but in a manner so that a space is extended perpendicularly or spread toward the upper layer. With this arrangement, the nozzles 300A and 300B can be positioned nearer. In this embodiment, in order to obtain a satisfactory ejection efficiency and adhesiveness between the substrate 305 and the orifice plate 308, different inclinations described above are employed to form the walls of the first pressure chambers 303A and 303B and the walls of the ink flow paths 306A and 306B. Furthermore, since the upper layers of the ink flow paths 306A and 306B are formed so they are wider than the lower layers, a large cross section can be obtained without a reduction in the size of a contact area being required.

As described above, in this embodiment, the area of the ink flow path 306 that is parallel to the heater formation face P is increased in the ink ejection direction, and is reduced toward the heater formation face P. Therefore, the walls that partition between the adjacent nozzles 300 become thicker in the vicinity of the ink flow paths 306. Therefore, a reduction in the strength of the print head 1 near the pressure chambers 500 is compensated for near the ink flow paths 306, and a high strength is maintained. Therefore, degradation of the reliability of the print head 1, wherein the inclined walls define the pressure chambers 500, can be prevented. Furthermore, since a large contact area is obtained for the substrate 305 and the orifice plate 308, peeling of the orifice plate 308 can be prevented. Thus, a phenomenon is avoided according to which there is an increased probability that the orifice plate 308 will be peeled off the substrate 305, because the contact area is reduced due to the structure, wherein walls that define the pressure chambers 500 are inclined, and that degradation of the reliability of the print head 1 will occur.

Next, the method for manufacturing the print head 1 of this embodiment will be described while referring to FIGS. 5A to 5P. The manufacturing method employed according to this embodiment is a print head manufacturing method whereby, at the least, either a pressure chamber 500 or an ink flow path 306 that has two differently shaped layers can be formed in an ink ejection direction.

FIG. 5A is a plan view of the state wherein heaters 302 are arranged on the substrate 305, and FIG. 5B is a cross-sectional view of this substrate 305 taken along line VB-VB. In this embodiment, the substrate 305 is formed of Si, and first, to provide a heater substrate, a plurality of the heaters 302A and 302B are formed on the Si substrate using pattern processing, for example. Furthermore, although not illustrated, wiring for applying voltages to the individual heaters is provided in accordance with a predetermined pattern. In addition, an insulating film (not shown) is arranged to cover the heaters 302A and 302B, and the substrate 305, so that insulating films overlaid layer are insulated from the heaters 302. Moreover, a protective film (not shown) is arranged to protect the surfaces of the heaters 302A and 302B from being damaged by cavitation, which occurs when bubbles burst and disappear, so that the protective film cover the insulating film.

Following this, a first resin layer 320 and a second resin layer 330, both of which are photosensitive layers, are sequentially applied to the substrate 305 on which the heaters 302A and 302B are arranged. In this embodiment, spin coating is employed to form the first resin layer 320 and the second resin layer 330. FIG. 5C is a plan view of the substrate 305 after the first resin layer 320 has been formed, and FIG. 5D is a cross-sectional view taken along line VD-VD in FIG. 5C. FIG. 5E is a plan view of the substrate 305 after the first resin layer 320 and the second resin layer 330 have been formed, and FIG. 5F is a cross-sectional view taken along line VF-VF in FIG. 5E. These resin layers 320 and 330 are photosensitive, so that portions thereof that have been exposed are solvent-soluble. Further, materials having different photosensitive characteristics are employed for the first resin layer 320 and the second resin layer 330, so that these layers respectively exhibit solvent solubility in different wavelength regions. Furthermore, in this embodiment, the second resin layer 330 is formed of a material that absorbs at least part of the photosensitive wavelength region of the first resin layer 320.

Sequentially, exposure equipment is employed to expose the substrate 305 that is coated with the first resin layer 320 and the second resin layer 330. At this time, in order to remain a predetermined pattern of the second resin layer 330, a second mask is used as a filter, and the second resin layer is exposed through the second mask. When the exposure is performed, the second resin layer 330 is exposed to light that corresponds to the photosensitive characteristic of the resin used. Specifically, light having a wavelength corresponding to a photosensitive characteristic that causes the second resin layer 330 to exhibit solvent solubility is employed for the exposure process. Then, after the second resin layer 330 has been exposed using the second mask, a solvent is used to dissolve and remove the exposed portion. As a result, as shown in FIGS. 5G and 5H, a predetermined nozzle pattern is obtained for the second resin layer 330. At this time, the second mask is required to block the light having wavelength so that the first resin layer 320 exhibits the photosensitivity to perform the process of patterning only to the second resin layer 330. FIG. 5G is a plan view of the substrate 305, the first resin layer 320 and the second resin layer 330 when a predetermined nozzle pattern has been formed using the second resin layer 330 and FIG. 5 H is a cross-sectional view taken along line VH-VH in FIG. 5G. Only the portions of the second resin layer 330 that were protected from the light by the mask remain on the substrate 305, and these are employed as a base pattern for the formation of ink flow paths.

Then, a first mask is employed as a filter, and the first resin layer 320, located beneath the second resin layer 330, is exposed in order to remain a predetermined pattern. During performing exposure to the first resin layer 320 through the first mask, light having the appropriate photosensitive characteristic is employed to expose the first resin layer 320. Specifically, light having a wavelength corresponding to the photosensitive characteristic that causes the first resin layer 320 to exhibit solvent solubility is employed for the exposure process. After the first resin layer 320 has been exposed using the first mask, a solvent is used to dissolve and remove the exposed portion of the first resin layer 320. As a result, as shown in FIGS. 5I and 5J, a predetermined nozzle pattern is obtained for the first resin layer 320. FIG. 5I is a plan view of the substrate 305, the first resin layer 320 and the second resin layer 330 when a predetermined nozzle pattern has been formed using the first resin layer 320, and FIG. 5J is a cross-sectional view taken along line VJ-VJ in FIG. 5I. Only those portions of the first resin layer 320 that were protected from exposure to light by the mask remain, and are employed as a base pattern for formation of the ink flow paths.

Further, in this embodiment, the first resin layer 320 absorbs part of the photosensitive wavelength used for the second resin layer 330, and is to be exhibited the photosensitivity using both the light having the photosensitive wavelength employed for the second resin layer 330 and the light that is emitted thereafter to perform the exposure. With this arrangement, the parts of the first resin layer 320 located beneath the residual portions of the second resin layer 330 remain, except for those that have been exposed to diffracted light, which will be described later.

Furthermore, during the processes performed for patterning the individual resin layers, light having a wavelength that is corresponding to the photosensitive characteristics of all the resin layers may be emitted, and a filter that permits the passage only of light for a specific wavelength region corresponding to the photosensitive characteristics of individual resin layers may be employed to expose individual resin. As another method, during each exposure process, the individual resin layers may be irradiated with light having different wavelengths. In this manner, each resin layer can be exposed to light having a wavelength corresponding to the photosensitive characteristic of that resin layer.

Figure 5K:
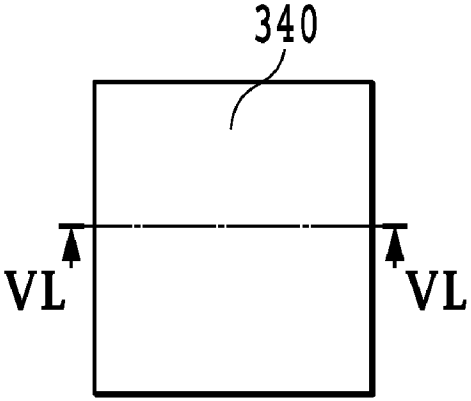
FIGS. 5A to 5P are diagrams for explaining the processing performed to manufacture the print head shown in FIGS. 3A to 3C.
Figure 5L:
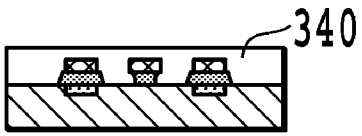
Figure 5I:
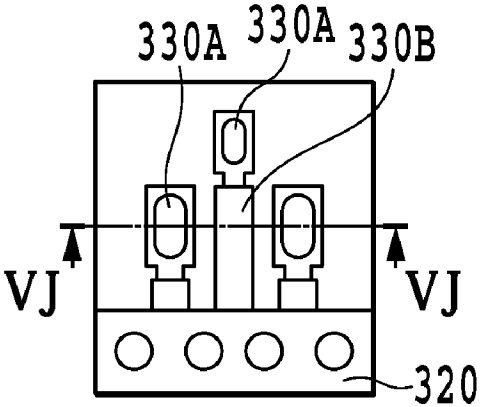
Figure 5J:
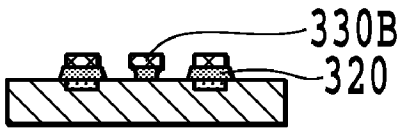
Figure 5G:
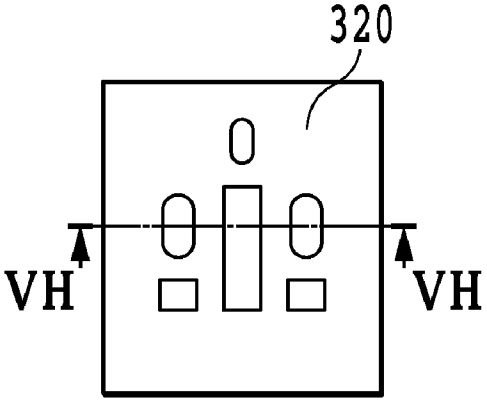
Figure 5H:
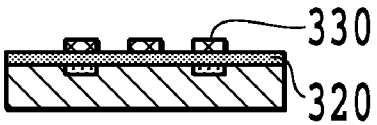

Next, as shown in FIGS. 5K and 5L, a flow path formation material 340, which is used to form the orifice plate, is formed to cover the substrate 305 where there are portions of the first resin layer 320 and of the second resin layer 330. FIG. 5K is a plan view of the substrate 305, the first resin layer 320 and the second resin layer 330 when the flow path formation material 340 is formed on the substrate 305, on which portions of the first resin layer 320 and of the second resin layer 330 remain, and FIG. 5L is a cross-sectional view taken along line VL-VL in FIG. 5K.

Figure 5O:
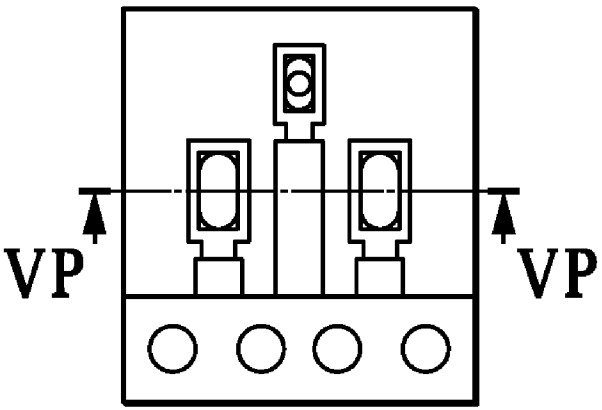
Figure 5P:
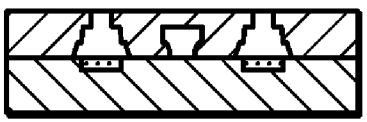
Figure 5M:
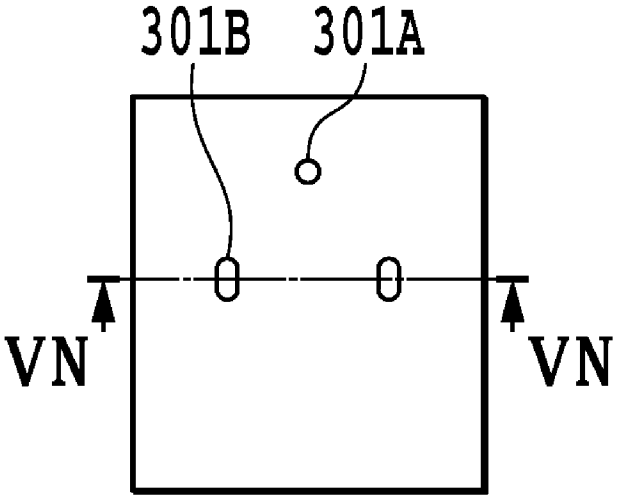
Figure 5N:
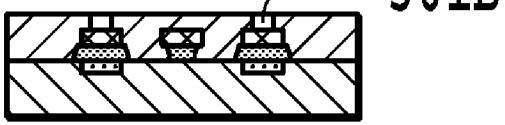

When the flow path formation material 340 has become solid, the ejection ports 301A and 301B are formed at predetermined positions, as shown in FIGS. 5M and 5N. FIG. 5M is a plan view of the flow path formation material 340, the substrate 305, the first resin layer 320 and the second resin layer 330 when the ejection ports 301A and 301B are formed in the flow path formation material 340, and FIG. 5N is a cross-sectional view taken along line VN-VN in FIG. 5M. For the formation of the ejection ports 301A and 301B in this embodiment, the exposure and development processes are performed and the portions corresponding to the ejection ports 301A and 301B are removed from the flow path formation material 340. Thus, the ejection ports 301A and 301B are formed in the flow path formation material 340. During the process for exposing the flow path formation material 340, a focus of the mask pattern may be used with underfocus or overfocus, so that the inner walls of the ejection ports 301 can be inclined.

Following this, as illustrated in FIGS. 5O and 5P, the first resin layer 320 and the second resin layer 330 are removed, using a predetermined etching fluid, except for those portions that, as a result of patterning, should remain. FIG. 5O is a plan view of the flow path formation material 340, the substrate 305, the first resin layer 320 and the second resin layer 330 when nozzles are formed by eliminating the portions that should be removed, and FIG. 5P is a cross-sectional view taken along line VP-VP in FIG. 5O. Through this processing, at the least, either pressure chambers 500 or ink flow paths 306 can be formed that have two differently shaped layers in the ink ejection direction. In this embodiment, both the ink flow paths 306 and the pressure chambers 500 are formed, on the heater substrate 305, that have two differently shaped layers in the ink ejection direction.

According to this embodiment, during the process for exposing the first resin layer 320, via the first mask, to leave a predetermined first resin layer pattern, the first resin layer 320 is exposed so that the ends of the first resin layer 320 are located under the second resin layer 330. In this case, by utilizing the diffraction of light, light is guided under the second resin layer 330 to expose the first resin layer 320. In addition, when the first resin layer 320 is to be remained, so that the walls of the residual layer portions are inclined outward in the ink ejection direction, the diffraction of light is utilized and light is guided under the first mask to expose the first resin layer 320. The path of light L at this time will be described while referring to FIG. 6.

Figure 6:
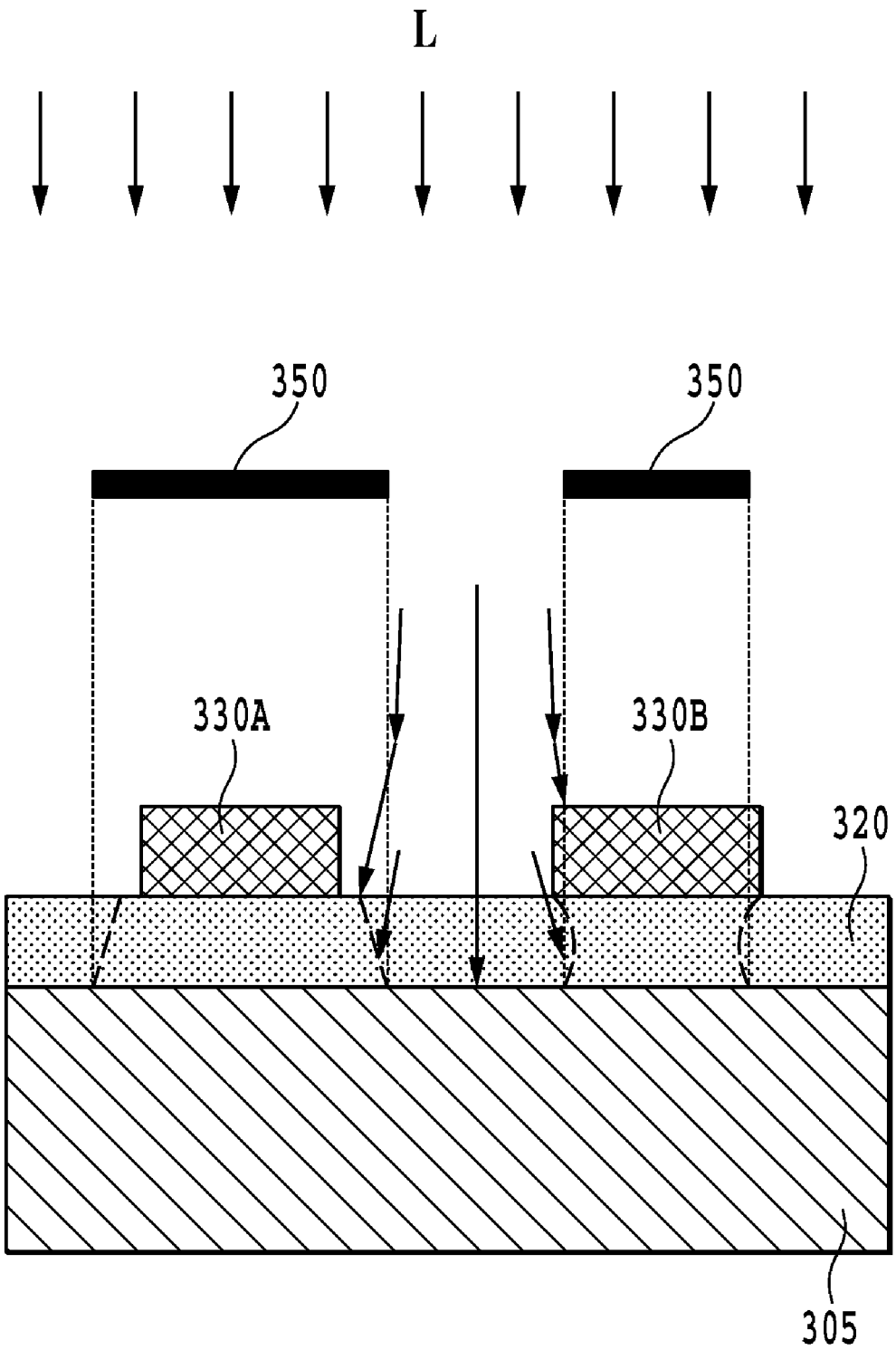
FIG. 6 is a schematic diagram for explaining the path of light employed to expose a first resin layer and a second resin layer.

As illustrated in FIG. 6, in a case wherein the edges of the first mask 350, used for exposing the first resin layer 320, are located inside the edges of the second layer 330B, light is diffracted at a height corresponding to about the middle of the first resin layer 320 and is guided inward below the second resin layer 330B. Therefore, in this region, the portion of the first resin layer 320 located in the inside of the second resin layer 330B is also exposed to diffracted light (or scattered light) during the exposure process, and is thereafter removed. On the other hand, the portion of the first resin layer 320 located immediately beneath the second resin layer 330B, to which the diffracted light can be guided, is not exposed to light because, when the light has passed the second resin layer 330B and until the first resin layer 320 is reached, light is attenuated or absorbed. In addition, since the diffracted light is weak, it is seldom that the diffracted light is guided deep into the lower portion of the first resin layer 320, so that the light rarely reaches the portion located further inward below the second resin layer 330B. Therefore, when the exposure process has been performed, the portion of the first resin layer 320 located under the second resin layer 330B, which has not been exposed, has a curved shape, and the diameter of the portion corresponding to the middle height of the first resin layer 320 is reduced, as shown in FIG. 6. Furthermore, for the unexposed portion of the first resin layer 320, the outermost side, in the ink ejection direction, is wider than the innermost side, in the ink ejection direction. Therefore, the edges of the unexposed portion of the first resin layer 320 are inclined, so that the width is increased outward, in the ink ejection direction.

Further, as the other example of this embodiment, during the process for exposing the first resin layer 320, via the first mask 350, part of the first resin layer 320 is inclined, so that the edges are positioned inward, as the outer position relative to the ink ejection direction. During this process, light is guided to the inside of the mask 350 using the diffraction of light. Referring to FIG. 6, since the edges of the second resin layer 330A are located inward of the edges of the mask 350, the second resin layer 330A does not block light diffracted by the mask 350. Therefore, the light diffracted using the mask 350 reaches the first resin layer 320 without being disturbed, and the diffracted light largely enters inward than the edge of the mask 350 at the upper portion of the first resin layer 320. Further, since diffracted light becomes weaker at the lower, deep portion of the first resin layer 320 as well as at the lower portion below the second resin layer 330B, it is difficult for diffracted light to enter inward, and the light seldom reaches the portion located inward the mask 350. As a result, when the second resin layer 330A is exposed, the portion of the first resin layer 320 below, which is not exposed, is inclined, so that outward the width is narrowed, relative to the ink ejection direction, i.e., the edges of the portion are positioned inward, relative to the ink ejection direction.

When the process for exposing the first resin layer 320 and the second resin layer 330 to light, via the mask, and eliminating the portions to be removed has been completed, the resin layers that are thus patterned are cured by being heated, for a predetermined period of time, at a temperature, for example, of about 120 to 140° C. Through this process, the walls that form the ink flow paths are inclined. And in this embodiment, it is preferable that the inclination angle of the wall faces of the first resin layer 320 be about 10° to 40°, for example.

As described above, the shape of the unexposed portion of the first resin layer 320 is controlled by adjusting the position of the mask. In this embodiment, as shown in FIG. 6, the shape of the unexposed portion of the first resin layer 320 is changed, depending on whether or not the mask 350 is positioned so that its edges are extended, relative to the edges of the residual portion of the second resin layer 330.

According to this embodiment, a flow path having two differently shaped layers in the ink ejection direction is employed for the pressure chambers and the ink flow paths. However, the present invention is not limited to this type of construction, and two or more layers may be laminated, in the ink ejection direction, to form a flow path. For this formation, n photosensitive resin layers (n: an integer) are sequentially formed on a substrate on which heaters are formed. Then, an n-th layer, which is the outermost laminated layer on the substrate, is exposed via an n-th mask to light that corresponds to the photosensitive characteristic of the n-th layer. As a result, part of the n-th layer is removed to form a predetermined pattern using the n-th layer.

The same processes as described above, for forming the predetermined pattern using the n-th resin layer, are repeated from an (n−1)th layer to the second resin layer. The first resin layer, which is arranged at the n-th position from the top, at the lowermost position, is exposed to light, via the first mask, that corresponds to the photosensitive characteristic of the first resin layer, and part of the first resin layer is removed to remain and form a predetermined pattern. Thereafter, a flow path formation material, used to form an orifice plate is deposited to cover the substrate on which the residual portions of the first to the n-th resin layers are arranged. Then, ejection ports are formed at predetermined positions, and parts of the first to the n-th resin layers are removed. As a result, at the least, pressure chambers or liquid flow paths, which are formed of multiple differently shaped layers, are obtained in a liquid ejection direction. This method may be employed for the manufacture of a print head for which three or more laminated resin layers are used.

Second Embodiment

A second embodiment of the present invention will now be described while referring to FIGS. 7A to 7C. In the second embodiment, the same reference numerals as used in the first embodiment are provided for the section for which the arrangement of the first embodiment can be applied, and no further description will be given therefor. Only different portions will be described.

Figure 7A:
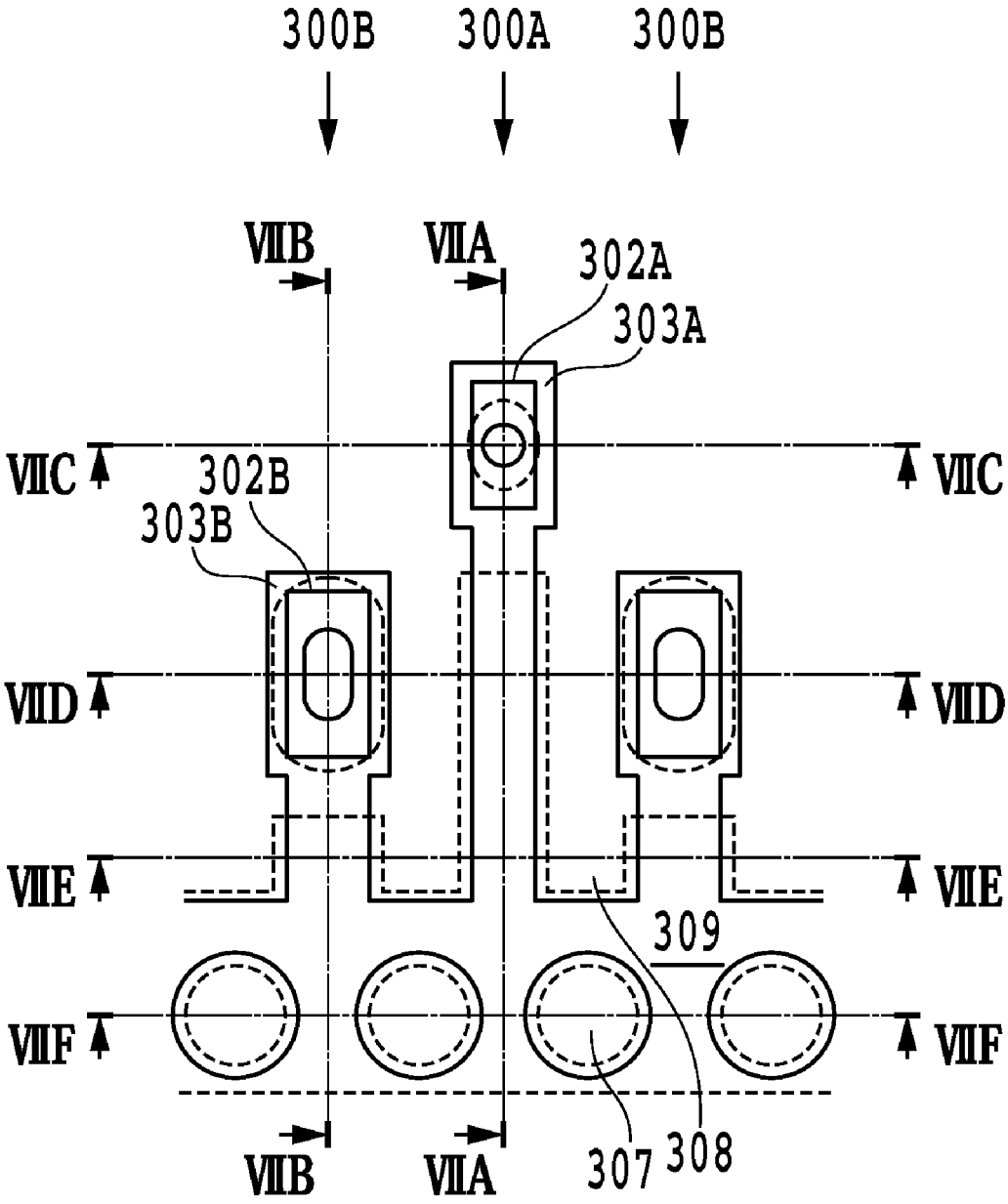
FIG. 7A is a plan view for explaining the nozzle arrangement of a print head according to a second embodiment of the present invention.
Figure 7B:
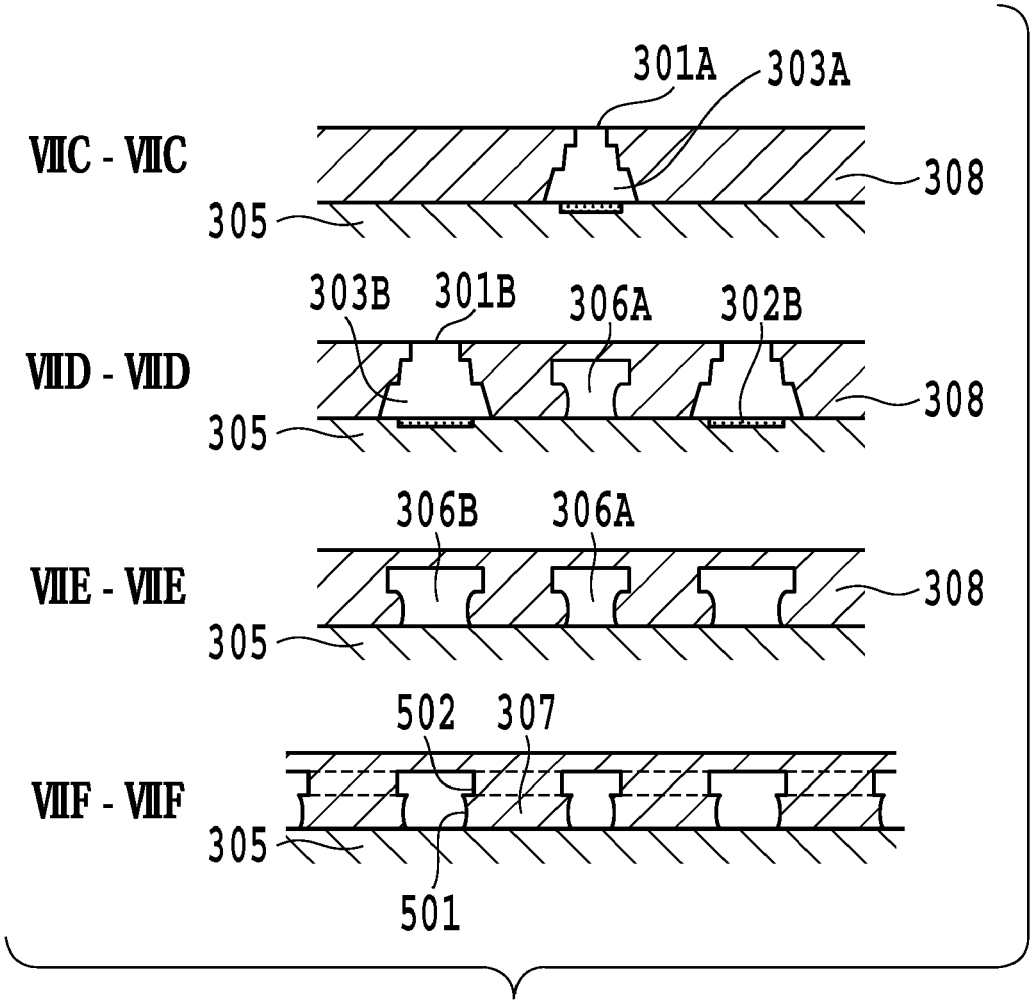
FIG. 7B is a cross-sectional view taken along lines VIIC-VIIC, VIID-VIID, VIIE-VIIE and VIIF-VIIF in FIG. 7A.
Figure 7C:
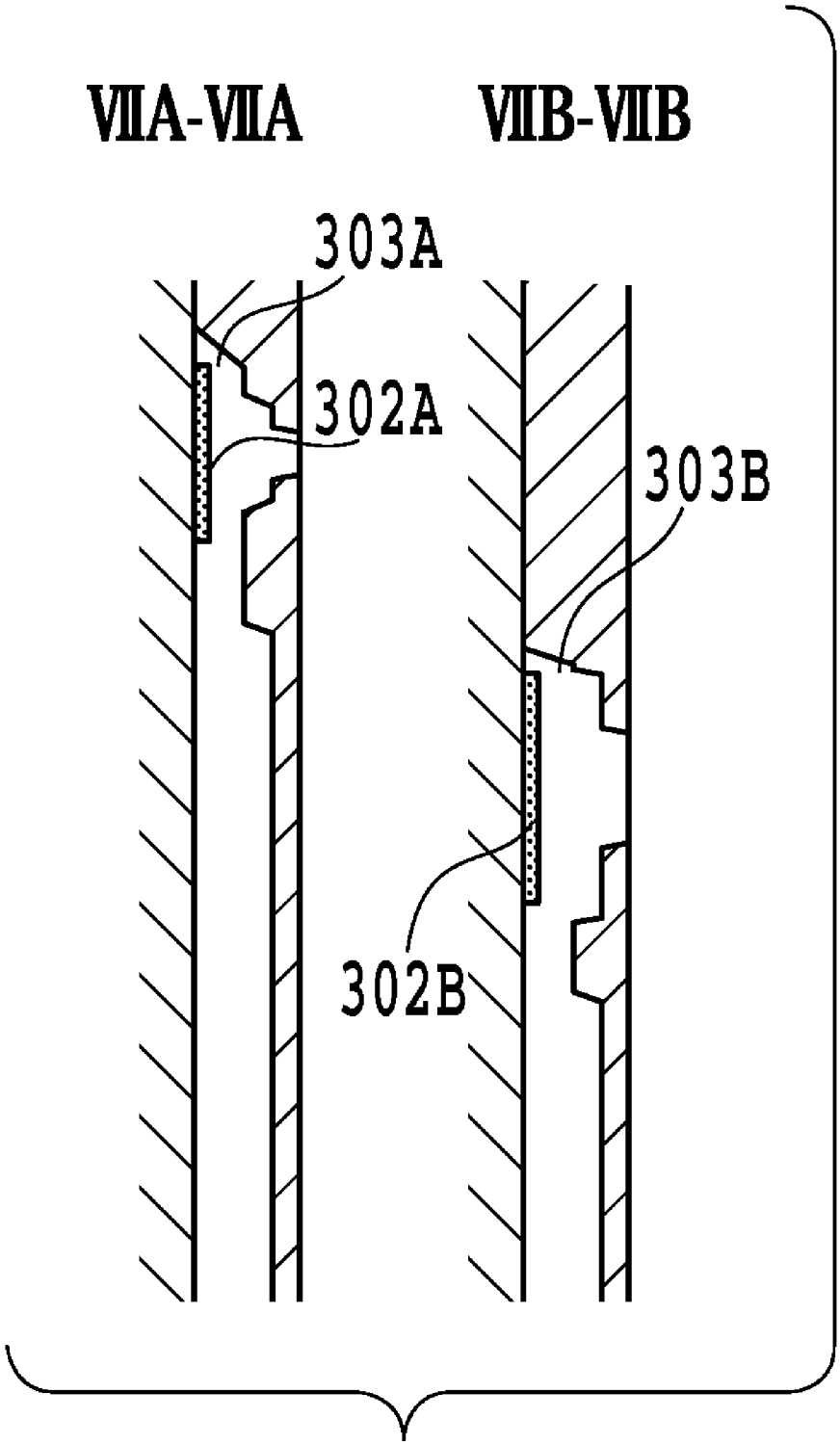
FIG. 7C is a cross-sectional view taken along lines VIIA-VIIA and VIIB-VIIB in FIG. 7A.

In this embodiment, as shown in a cross-sectional view in FIG. 7B, taken along line VIIF-VIIF in FIG. 7A, filters 307 are integrally formed with an orifice plate 308. Each filter 307 of this embodiment is a columnar form located at an interval between the channels extended from an ink flow path 306A and an ink flow path 306B. Furthermore, each filter 307 is formed of two layers and two layers are attached each other: an upper layer, which is an almost circular member 502, and a lower layer, which is a flange member 501 having concave side faces. The flange member 501 is thicker than the circular member 502.

Further, the area of the VIIF-VIIF cross section of the flow path, between the adjacent filters 307 and the area of the cross-section (not shown) between the end of the orifice plate 308 and the filter 307, is the same as the area of the IIIF-IIIF cross section shown in FIG. 3 for the first embodiment. Therefore, the size of the contact area between a substrate 305 and the orifice plate 308 is increased, while the same filtering function as that performed by the filters 307 in the first embodiment, and the same ink supply function as that provided by the first embodiment can be maintained. In this manner, the adhesiveness of the heater substrate 305 and the filter 307 is improved. In addition, the circular member 502, which is the upper layer of the filter 307, and the flange member 501, which is the lower layer, may be formed so they have the same thickness, even though, in this embodiment, the circular member 502 that is formed is thinner than the flange member 501, i.e., the portion formed for the ink flow path is larger. With this arrangement, since a large contact area is obtained for the heater substrate 305 and the orifice plate 308, the size of the flow path can be increased without the adhesiveness being adversely affected and the ink supply function can be improved.

A first pressure chamber will now be described while referring, for comparison, to the VIIA-VIIA cross section and the VIIB-VIIB cross section in FIG. 7C. In this embodiment, the first pressure chamber has a nozzle 300A, for which a long ink flow path is extended from a common liquid chamber 309 to a pressure chamber, an inclination of walls that is greater, relative to a reference face perpendicular to a heater formation face, than the first pressure chamber that has a nozzle 300B, for which a short ink flow path is extended. This is because, for the nozzle 300B, since the ink flow path 306A of the nozzle 300A is located very near the first pressure chamber 303B, keeping the contact area for the heater substrate 305 and the acquisition of strength for the nozzle 300B are the priorities. Therefore, for the nozzle 300B, the walls that define the first pressure chamber 303B are less inclined, relative to the reference face perpendicular to the heater formation face. On the other hand, for the nozzle 300A, in that ink flow paths for the other nozzles are not formed in the vicinity, the walls that define the first pressure chamber 303A are inclined as much as possible within a range that will not provide harmful effects. In this manner, the ejection efficiency of the nozzles 300A is increased. According to the arrangement for this embodiment, a larger amount of ink is to be ejected by the nozzles 300B than by the nozzles 300A, and the heater size is also larger for the nozzles 300B. However, this size relationship may be reversed. Then, the ejection efficiency may be improved for the nozzles 300A having the larger heaters, and the effects obtained by controlling heat generation for the print head will be more pronounced.

Third Embodiment

Figure 8A:
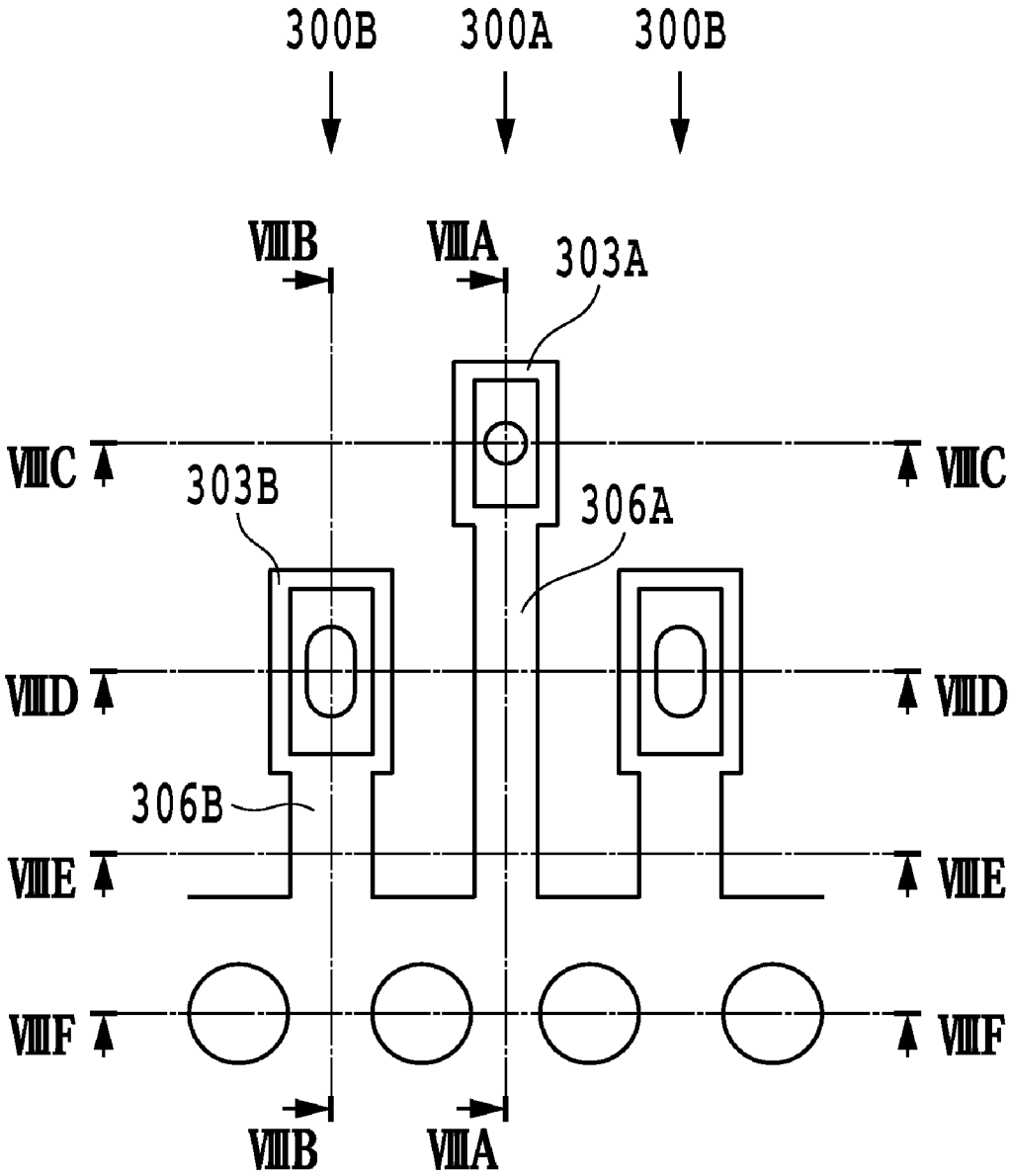
FIG. 8A is a plan view for explaining the nozzle arrangement provided for a print head according to a third embodiment of the present invention.
Figure 8B:
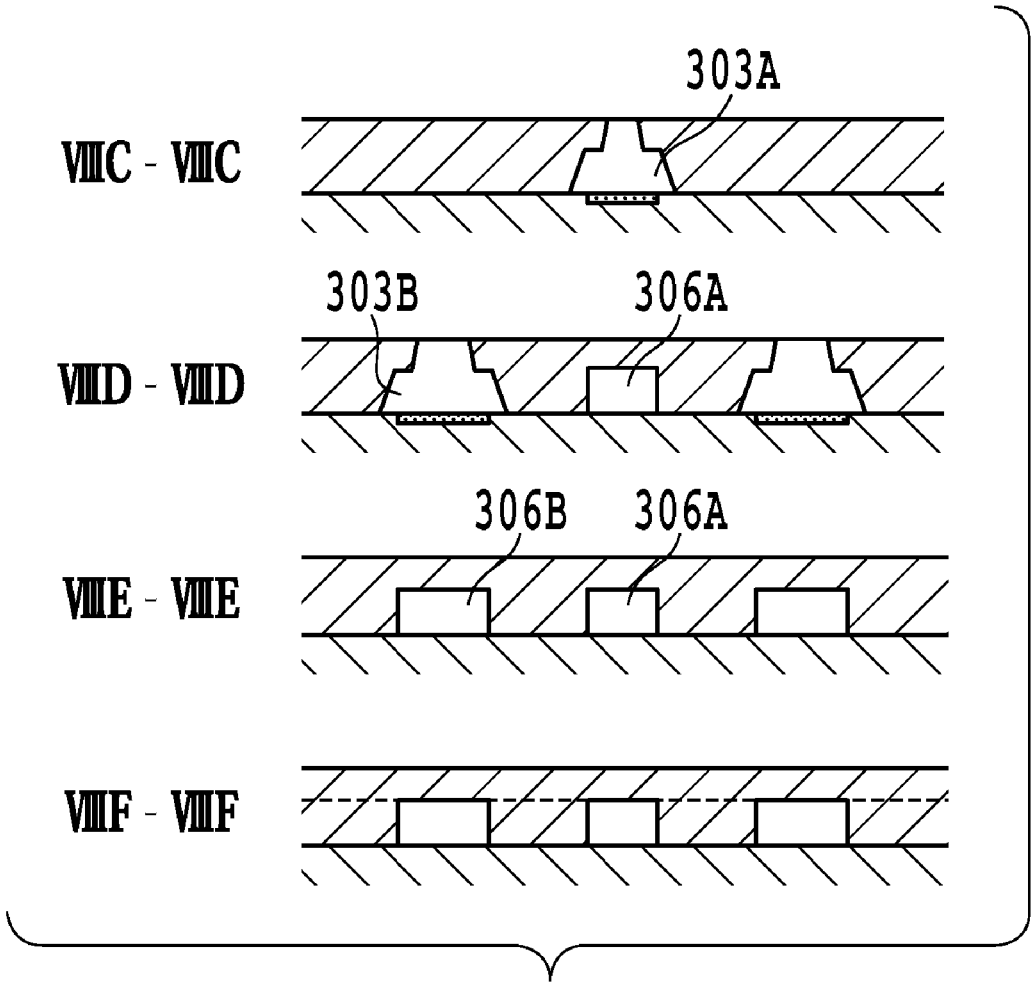
FIG. 8B is a cross-sectional view taken along lines VIIIC-VIIIC, VIIID-VIIID, VIIIE-VIIIE and VIIIF-VIIIF in FIG. 8A.
Figure 8C:
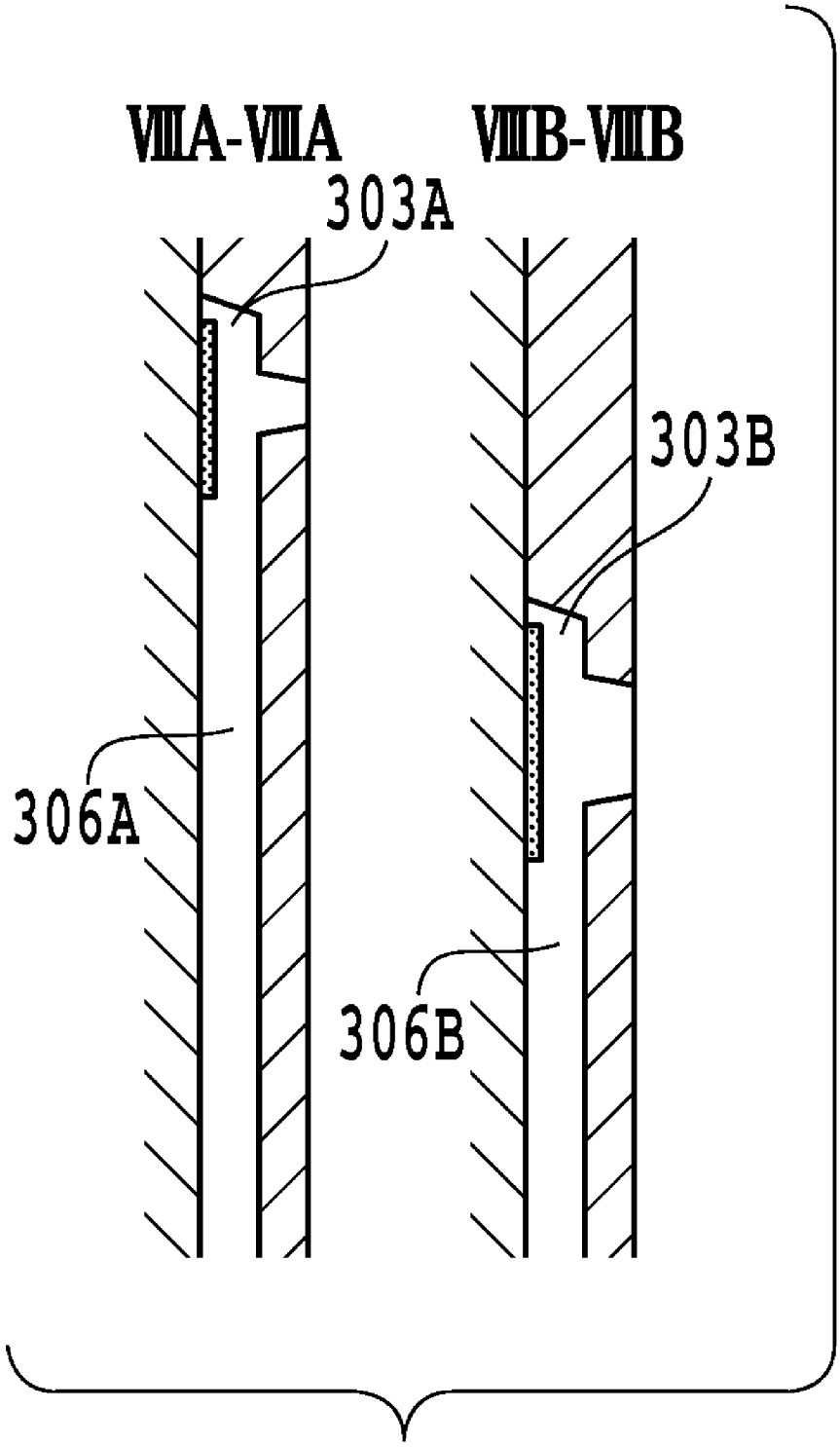
FIG. 8C is a cross-sectional view taken along lines VIIIA-VIIIA and VIIIB-VIIIB in FIG. 8A.
Figure 9:
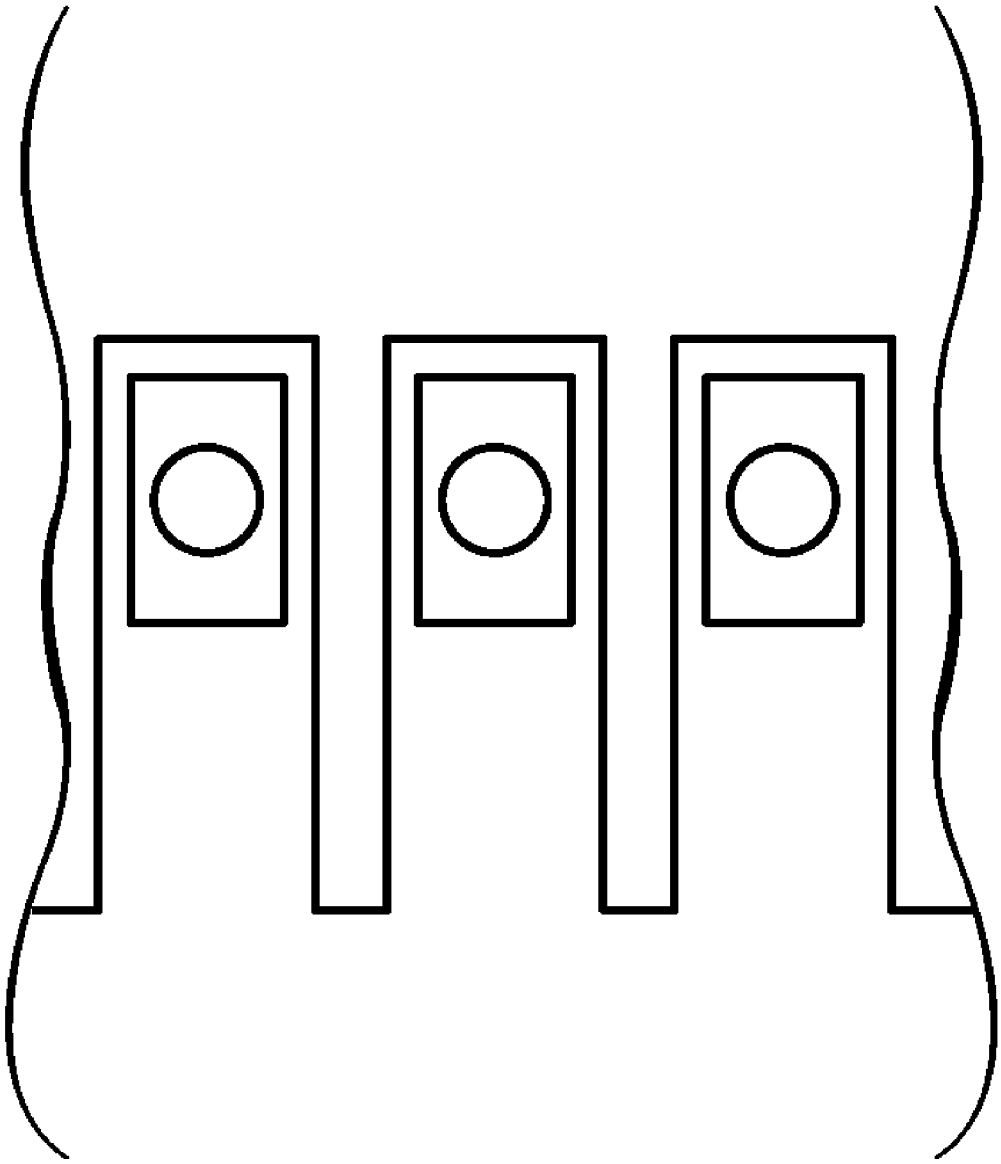
FIG. 9 is a cross-sectional view of the nozzle arrangement provided for a conventional print head.

A third embodiment of the present invention will now be described while referring to FIGS. 8A to 8C. In the third embodiment, the same reference numerals as used in the first and second embodiments are provided for sections for which the arrangements of the first and second embodiments can be applied, and no further description will therefor be given. Only different portions will be described. In this embodiment, as shown in FIGS. 8A to 8C, first pressure chambers 303A and 303B and ink flow path 306A and 306B are formed using only one layer. As in the first and second embodiments, the present invention is applied for a print head using this type of pressure chamber.

When a nozzle in this embodiment is to be produced, before a pattern material (resin layer) for forming ink flow paths is patterned, different masks are employed for the first pressure chambers 303A and 303B, whose walls are to be greatly inclined, and ink flow paths 306A and 306B, whose walls are to be only slightly inclined.

Then, patterning is simply performed for the first pressure chambers 303A and 303B and the ink flow paths 306A and 306B under different exposure conditions. For example, when a resin layer corresponding to the portions for the first pressure chambers 303A and 303B is to be formed, the magnitude of exposure may be increased until more than that when a resin layer is to be formed that corresponds to portions for the ink flow paths 306A and 306B.

Other Embodiment

A liquid ejection head according to this invention can be mounted on equipment such as a printer, a copier, a facsimile machine that includes a communication system or a word processor that includes a printer, or multifunctional industrial recording equipment assembled with various types of processing apparatuses. When the liquid ejection head is employed, printing is enabled on various types of recording media, such as paper, yarn, fiber, cloth, metal, plastic, glass, wood and ceramics. It should be noted that "printing" as employed in the specification for this invention represents not only the provision of semantic images, such as characters or graphics, for a recording medium, but also images such as patterns that do not convey any meaning.

Moreover, the meaning of "ink" or of "liquid" should be widely interpreted, i.e., should be a liquid that is applied to a printing medium to form an image, a design or a pattern, or to perform finishing of a printing medium, or that is employed for the processing of ink or a printing medium. In this case, the processing of ink or of a printing medium includes, for example: an improvement in the fixing property of ink applied to a recording medium by accelerating the coagulation of the coloring material contained in the ink, or by rendering the coloring material insoluble; an improvement in a printing quality or in a coloring property; or an improvement in image durability.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2008-027696, filed Feb. 7, 2008, which is hereby incorporated by reference herein in its entirety.

What is claimed is:

1. A liquid ejection head comprising:

an energy application chamber for internally containing a liquid;

a printing element, located in the energy application chamber for generating energy that is to be applied to the liquid contained in the energy application chamber;

an ejection port, communicating with the energy application chamber, for ejecting the liquid to which the energy is applied by the printing element; and a liquid flow path used to supply the liquid from a liquid supply port to the energy application chamber, wherein walls defining the energy application chamber and formed along a first direction defined from the liquid supply port to the printing element are inclined inward, within the energy application chamber, relative to a second direction perpendicular to a printing element formation face on which the printing element is arranged, wherein walls defining the liquid flow path and formed along the first direction are inclined relative to the second direction, and wherein an angle at which the walls defining the liquid flow path are inclined relative to the second direction is smaller than an angle at which the walls defining the energy application chamber are inclined inward relative to the second direction, within the energy application chamber.

2. The liquid ejection head according to claim 1, wherein the walls defining the liquid flow path include a portion that is inclined outward relative to the second direction, so that the liquid flow path broadens in the liquid ejection direction.

3. The liquid ejection head according to claim 1, wherein a portion of the liquid flow path positioned outermost relative to the second direction is wider than a portion positioned innermost relative to the liquid ejection direction.

4. The liquid ejection head according to claim 3, wherein the liquid flow path has a shape such that two flow paths that are almost rectangular in cross-section are arranged in parallel, and wherein the flow path located outside relative to the second direction is wider than the flow path located inside relative to the second direction.

5. The liquid ejection head according to claim 1, wherein the energy application chamber includes a first energy application section, which communicates with the liquid flow path, and a second energy application section, which communicates with the ejection port, and wherein an inclination of walls, which define the first energy application section, in the interior of the energy application chamber is greater than an inclination of walls, which define the second energy application section, in the interior of the energy application chamber.

6. The liquid ejection head according to claim 1, wherein the energy application chamber includes a first energy application section, which communicates with the liquid flow path, and a second energy application section, which communicates with the ejection port, and wherein the first energy application section has a volume that is greater than that of the second energy application section.

7. The liquid ejection head according to claim 1, wherein a plurality of the liquid flow paths having different lengths are arranged in parallel along a third direction crossing the first direction, and a plurality of energy application chambers and ejection ports are provided corresponding to the liquid flow paths, and wherein a portion of an energy application chamber, corresponding to a short liquid flow path, that is farthest from the liquid supply port is nearer the liquid supply port than a portion of an energy application chamber, corresponding to a long liquid flow path, that is nearest the liquid supply port.

8. The liquid ejection head according to claim 7, wherein an amount of a liquid to be ejected from the ejection port corresponding to the short liquid flow path is greater than an amount of a liquid to be ejected from the ejection port corresponding to the long liquid flow path.

* * * * *